US006079128A

United States Patent [19]

Hoshizaki et al.

[11] Patent Number: 6,079,128

[45] **Date of Patent: *Jun. 27, 2000**

[54] SKATE BOOT CONSTRUCTION WITH INTEGRAL PLASTIC INSERT

[75] Inventors: T. Blaine Hoshizaki, Montreal West; René Bourque, Laval; Gerald Black, Cambridge, all of Canada

[73] Assignee: Bauer Nike Hockey Inc., Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,077

[22] Filed: Sep. 1, 1997

Related U.S. Application Data

[63] Continuation of application No. 08/614,900, Mar. 13, 1996, abandoned, which is a continuation of application No. 08/453,375, May 30, 1995, abandoned, which is a continuation of application No. 08/159,148, Nov. 30, 1993, abandoned.

[51] Int. Cl.[7] ..... A43B 7/20; A43B 23/08; A43B 5/04

[52] U.S. Cl. ..... 36/89; 36/115; 36/92; 36/69

[58] Field of Search ..... 36/45, 55, 71, 36/68, 69, 88, 89, 92, 93, 114, 115

[56] References Cited

U.S. PATENT DOCUMENTS

| | | | |
|---|---|---|---|
| D. 300,685 | 4/1989 | Le et al. . | |
| 991,036 | 5/1911 | Spiegelman | 36/55 |
| 1,034,649 | 8/1912 | Rice . | |
| 1,064,479 | 6/1913 | Healy | 36/89 |
| 1,187,817 | 6/1916 | Collis . | |
| 1,371,623 | 3/1921 | Ickenroth . | |
| 1,522,256 | 1/1925 | Meyers | 36/89 |
| 1,527,840 | 2/1925 | Chomin . | |
| 1,539,445 | 5/1925 | Van Buuren . | |
| 1,597,108 | 8/1926 | Planert . | |
| 1,607,103 | 11/1926 | Sesby . | |
| 1,610,700 | 12/1926 | Morton . | |
| 1,726,579 | 9/1929 | Oestrick . | |

(List continued on next page.)

FOREIGN PATENT DOCUMENTS

| | | | |
|---|---|---|---|
| 0 117 372 | 9/1984 | European Pat. Off. . | |
| 0 389 215 | 9/1990 | European Pat. Off. . | |
| 0 521 288 A1 | 5/1992 | European Pat. Off. . | |
| 314901 | 5/1917 | Germany | 36/89 |
| 1 785 151 | 8/1968 | Germany . | |
| 88 07 537 U | 7/1988 | Germany . | |
| 1106958 | 3/1968 | United Kingdom . | |
| WO 89/09552 | 10/1989 | WIPO . | |

OTHER PUBLICATIONS

Search Report—PCT Application No. PCT/CA94/00661.

*Primary Examiner*—M. D. Patterson
*Attorney, Agent, or Firm*—Finnegan, Henderson, Farabow, Garrett & Dunner, LLP

[57] ABSTRACT

A skate boot is described in which a one-piece plastic ankle and heel counter insert is employed, positioned between the various layers which make up the skate boot. In sequence from outside to inside, the boot includes a conventional outer, the one-piece plastic insert, suitable cushioning, and a lining. The insert has a heel counter portion which is generally U-shaped and which cups around the heel area from along the lateral side, across the heel, and along the medial side, and an integral ankle portion which extends upwardly from the heel area of the heel counter portion and which includes forwardly projecting wing portions which cup around the ankle area from over the area of the lateral malleolus, across the rear and over the area of the medial malleolus. Preferably, the plastic insert extends up most of the height of the back of the boot, and includes lateral and medial cuff portions which extend partially forward along the sides of the skater's upper ankle. The one-piece plastic insert provides improved performance and rigidity over conventional separate inserts, while avoiding the tendency of the ankle portion of the skate boot to slump down onto the heel portion with time.

14 Claims, 7 Drawing Sheets

U.S. PATENT DOCUMENTS

| | | | |
|---|---|---|---|
| 1,798,590 | 3/1931 | Collis . | |
| 1,801,205 | 4/1931 | Mirick . | |
| 1,868,548 | 7/1932 | Turner . | |
| 2,080,959 | 5/1937 | Cobb | 36/169 |
| 2,120,987 | 6/1938 | Murray . | |
| 2,121,907 | 6/1938 | Easton . | |
| 2,147,455 | 2/1939 | Murray . | |
| 2,218,209 | 10/1940 | Marshall . | |
| 2,362,824 | 11/1944 | Hueston . | |
| 2,505,076 | 4/1950 | West et al. . | |
| 2,643,888 | 6/1953 | Hargis, Jr. . | |
| 2,644,692 | 7/1953 | Kahlert . | |
| 2,738,600 | 3/1956 | Shultz | 36/68 |
| 2,741,039 | 4/1956 | Mathews . | |
| 2,763,071 | 9/1956 | Napier | 36/115 |
| 2,868,553 | 1/1959 | Rieckman . | |
| 2,878,593 | 3/1959 | Lockridge | 36/169 |
| 2,909,375 | 10/1959 | Warner . | |
| 2,994,136 | 8/1961 | Reinhart et al. | 36/68 |
| 3,237,319 | 3/1966 | Hanson | 36/89 |
| 3,394,473 | 7/1968 | Romen | 36/68 |
| 3,807,062 | 4/1974 | Spier . | |
| 4,038,762 | 8/1977 | Swan, Jr. | 36/89 |
| 4,385,456 | 5/1983 | Livernois et al. . | |
| 4,706,316 | 11/1987 | Tanzi | 36/68 |
| 4,783,911 | 11/1988 | Brown | 36/115 |
| 4,835,885 | 6/1989 | Hoshizaki et al. | 36/115 |
| 4,869,001 | 9/1989 | Brown | 36/115 |
| 4,909,523 | 3/1990 | Olson . | |
| 5,331,752 | 7/1994 | Johnson et al. . | |
| 5,437,466 | 8/1995 | Melbock et al. . | |
| 5,438,769 | 8/1995 | Mazzarolo | 36/89 |

SKATE BOOT CONSTRUCTION WITH INTEGRAL PLASTIC INSERT

This application is a continuation, of application Ser. No. 08/614,900, filed Mar. 13, 1996, now abandoned which was a Continuation of Ser. No. 08/453,375, filed May 30, 1995, now abandoned, which was a Continuation of Ser. No. 08/159,148, filed Nov. 30, 1993, and abandoned.

BACKGROUND OF THE INVENTION

This invention relates to a boot construction, especially for ice skates or in-line roller skates, but not necessarily limited to same.

In skate boots, there are somewhat conflicting requirements for rigidity and comfort which, particularly in recent years, have led to increasingly sophisticated boot constructions in the perhaps never-ending quest for the "perfect" skate. In high-end skates such as those worn by professional hockey players, the twin requirements of rigidity and comfort are magnified. Performance must be optimized, and frequent wearing demands comfort, not just for the sake of comfort itself, but also to prevent blistering or other forms of injury to the foot (short term or long term).

One means which has been used in skates to increase rigidity is to employ plastic ankle inserts and heel counter inserts, sewn in between the layers of various materials which make up the boot. When skates are relatively new, this is fairly effective both in terms of rigidity and comfort. After considerable use of the skate, however, the leather and other materials naturally soften and become less rigid from repeated flexing, with the result that the upper ankle portion of the boot tends to slump down onto or over the heel counter, typically creating a ridge on the inside of the skate. This ridge bears against the Achilles' tendon, and thus creates a pressure point which results in decreased comfort and potential for blistering or other injury. The present invention is aimed specifically at avoiding that problem, and generally at providing an improved skate boot.

SUMMARY OF THE INVENTION

In the invention, a one-piece plastic ankle and heel counter insert is employed, positioned between the various layers which make up the skate boot. In sequence from outside to inside, the boot includes a conventional outer, the plastic insert, suitable cushioning means, and a lining. The insert has a heel counter portion which is generally U-shaped and which cups around the heel area from along the lateral side, across the heel, and along the medial side, and an integral ankle area which extends upwardly from the heel counter portion and which includes forwardly projecting wing portions which cup around the ankle area from the lateral side, across the rear and along the medial side.

Preferably, the plastic insert extends up most of the height of the back of the boot, and includes lateral and medial cuff portions which extend partially forward around the skater's upper ankle.

Preferably, to permit flexing of the ankle with minimal restriction, slots are provided between the wing portions and the sides of the heel counter portion.

The concept of the invention, i.e. the use of a one-piece plastic insert where separate pieces have been used before, is quite simple. However, in practice this has been difficult to achieve, and does not appear to have been previously considered, since conventional boot manufacturing assembly sequences have had to be changed to accommodate insertion of the one-piece insert. It has therefore not been natural to try this approach, due to the process changes involved, and has required a change in approach and thinking.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

All of the drawings are of a left skate.

DETAILED DESCRIPTION OF THE PREFERRED EMBODIMENT

Figure 1:
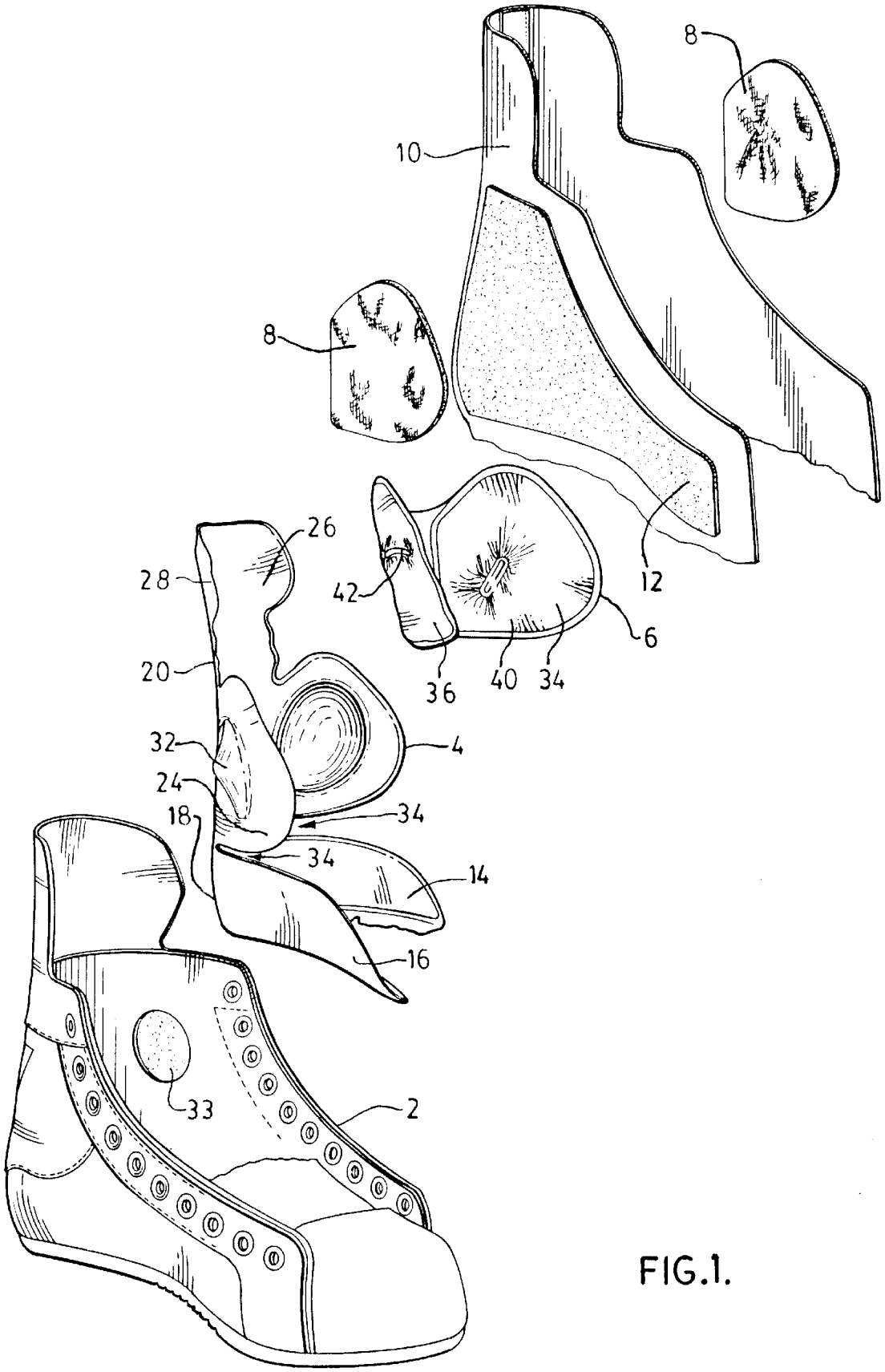
FIG. 1 is an exploded perspective view of the preferred embodiment of the skate boot.
Figure 2:
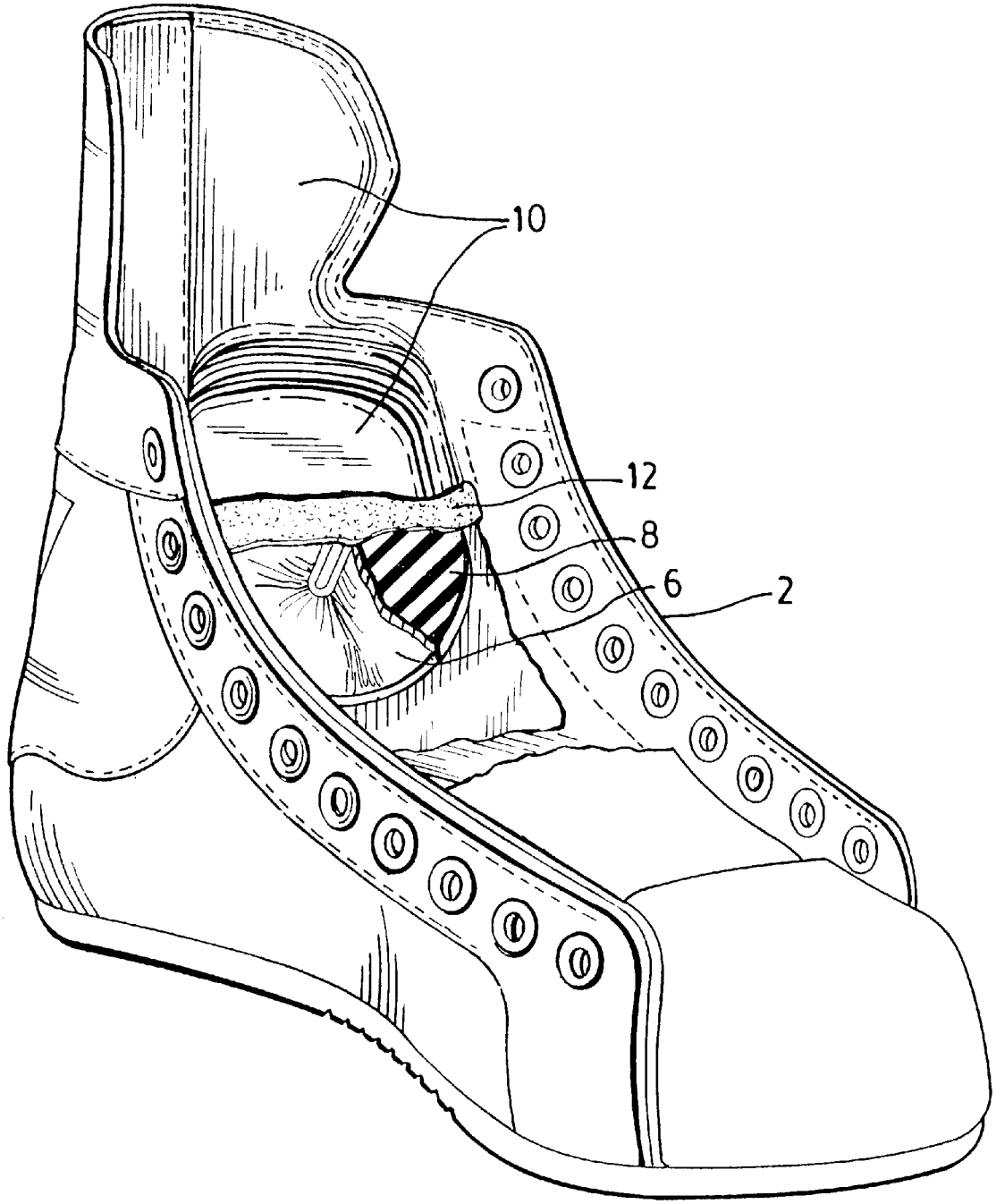
FIG. 2 is a perspective view of the skate boot, cut open to show details of the construction.
Figure 3:
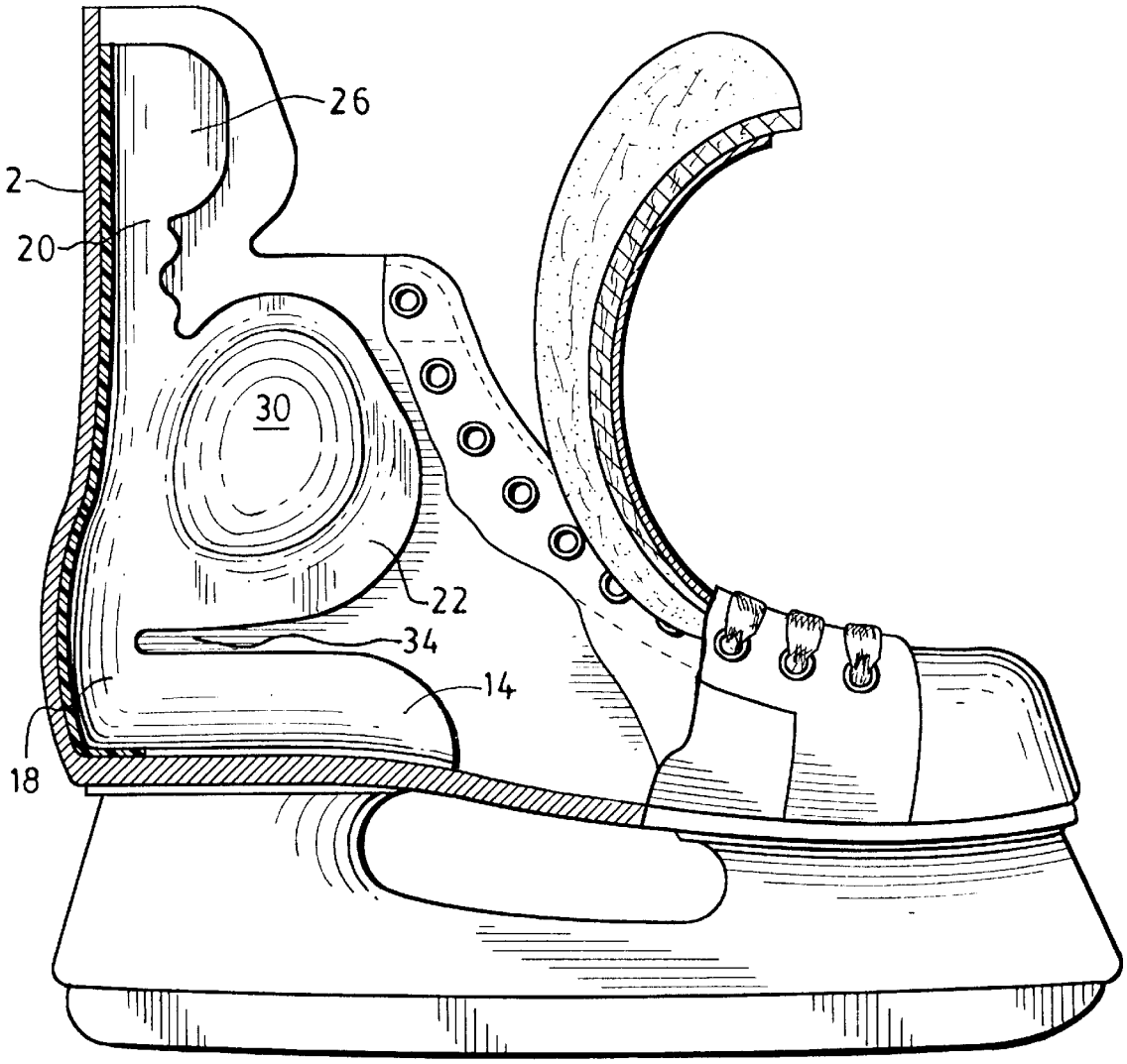
FIG. 3 is a right side elevation of the skate, in cross-section, after positioning of the insert, but prior to positioning of the cushioning means and lining.
Figure 4:
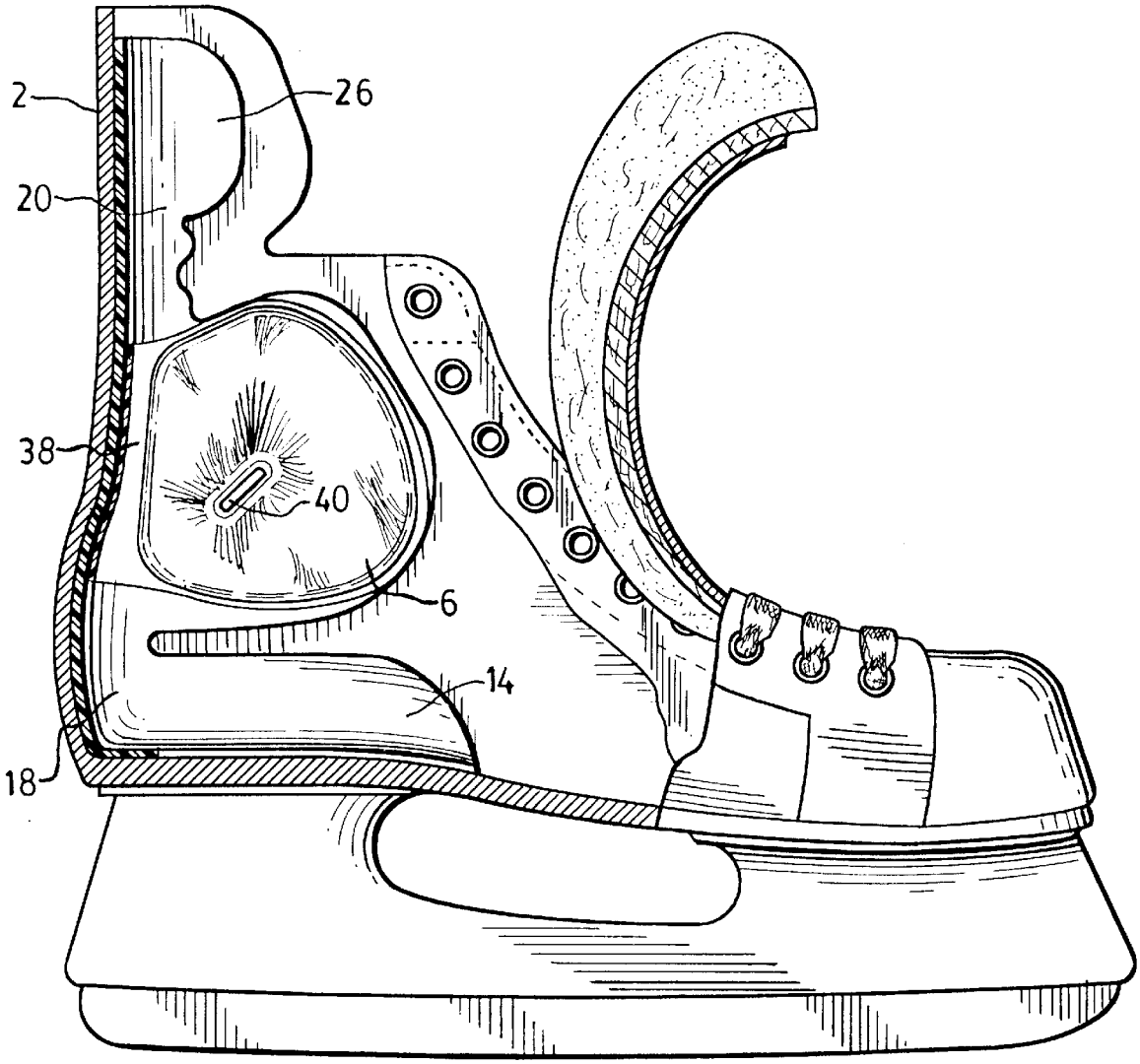
FIG. 4 is a right side elevation view of the skate, in cross-section, after positioning of the insert and the cushioning pack of flowable material, but prior to positioning of the neoprene rubber pad and of the lining, showing the lateral side of the insert and cushioning pack.
Figure 5:
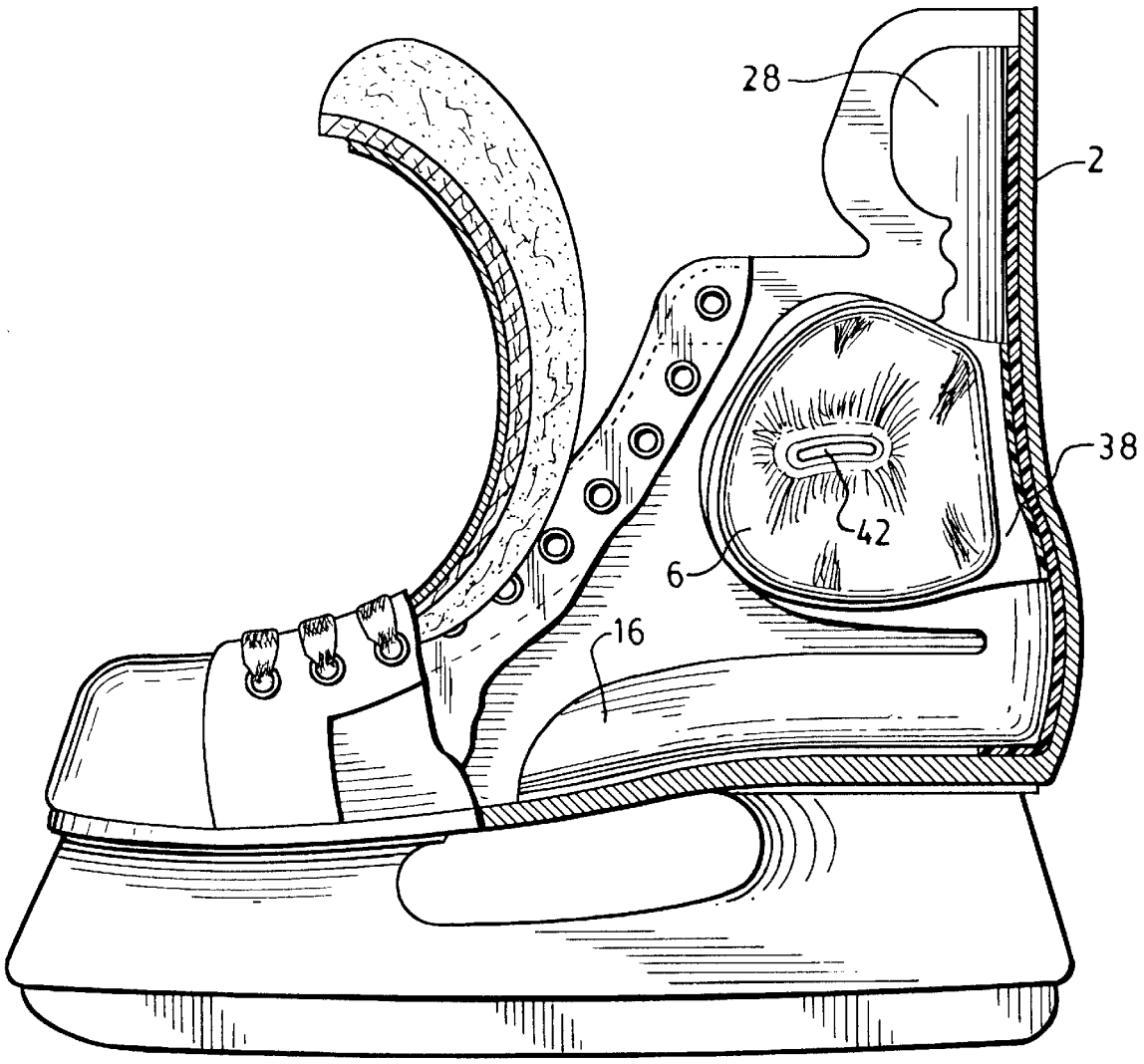
FIG. 5 is a left side elevation view of the skate, in cross-section, corresponding to FIG. 4 and showing the medial side of the insert and cushioning pack.
Figure 6:
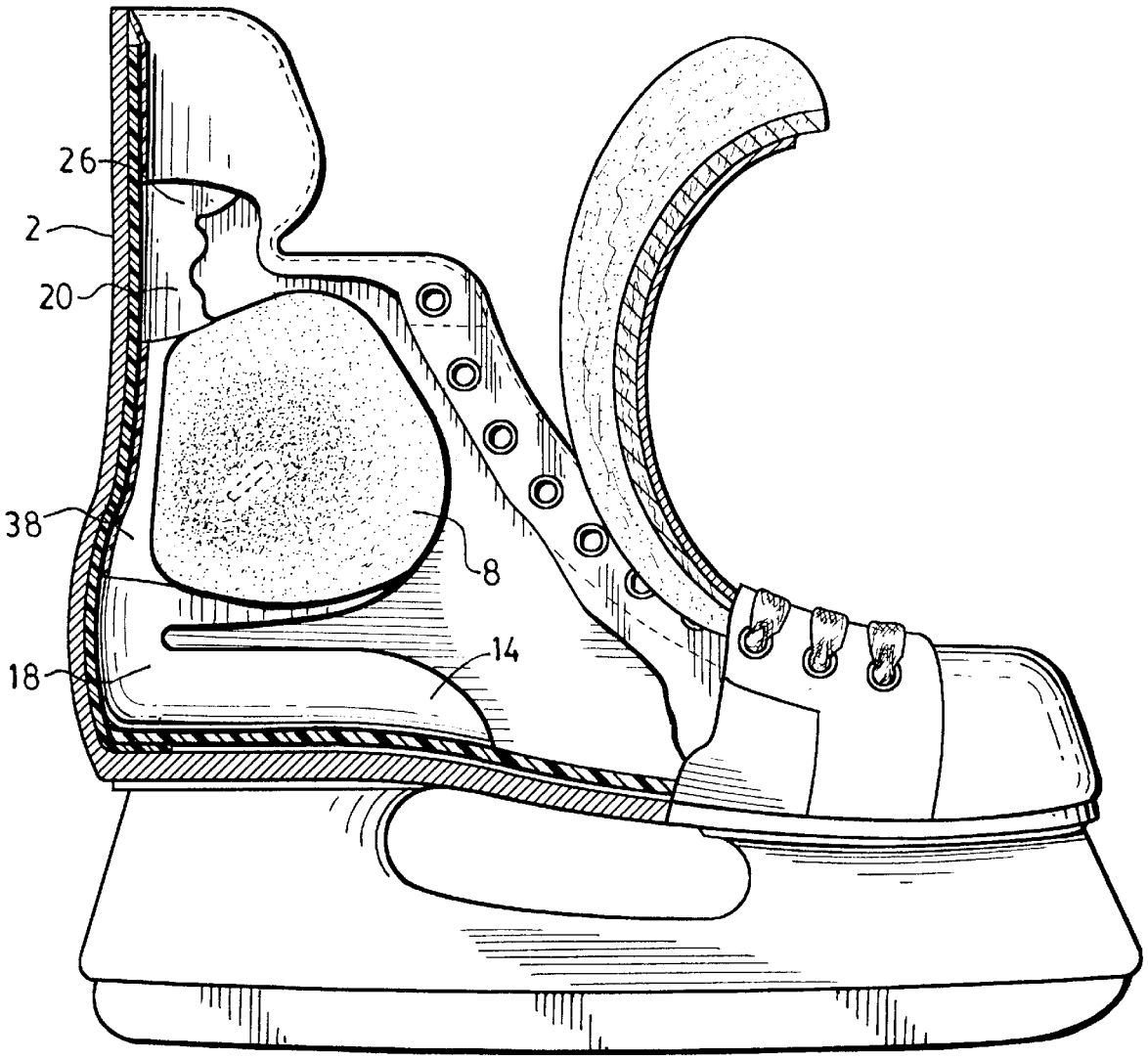
FIG. 6 is a right side elevation view of the skate, in cross-section, after positioning of the insert, the cushioning pack of flowable material and the neoprene rubber pad, but prior to positioning of the lining.

Referring to the drawings, the invention will now be described in greater detail. FIG. 1 shows the various components of the skate boot in exploded fashion. From the outside to the inside, the skate boot is made up of:

- a typical skate boot outer 2, conventionally having various layers of leather, plastic, ballistic nylon and/or other materials portions sewn together;
- the plastic insert 4 of the present invention;
- cushioning means such as, preferably, a cushioning pack 6 of flowable gel-like material which will conform to the particular individual's ankle shape, and neoprene rubber pads 8; and
- a soft material lining 10, preferably having a thin foam layer 12 bonded to the outside thereof.

The essence of the present invention resides in the one-piece plastic ankle/heel counter insert 4. It is made of a suitable plastic such as thermoplastic polyurethane, and is relatively thin (about 2.5 mm at its thickest central portions, thinning near the edges down to zero) so as to not add too much weight to the skate. Because it is fairly thin, it is somewhat flexible, but nevertheless does add a fair amount of rigidity to the overall structure of the boot.

The insert includes lateral and medial side portions 14 and 16 which extend forward from the heel area 18; a rear ankle portion 20 extending upwardly from the heel area; lateral and medial wing portions 22 and 24 arranged to overlie the malleoli of the skater's ankle; and lateral and medial cuff portions 26 and 28 to wrap partially around the skater's upper ankle.

Preferably, in order to be as nearly anatomically correct as possible, the lateral and medial wing portions include dished areas 30 and 32 to accommodate the malleoli. The boot outer 2 preferably includes recesses 33 to accommodate these dished areas.

To permit flexing of the ankle with minimal restriction, slots 34 preferably are provided between the wing portions and the side portions 14 and 16.

Figure 7:
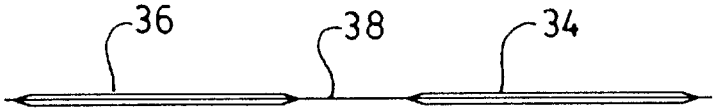
FIG. 7 is an elevation view of the cushioning pack laid flat.
Figure 8:
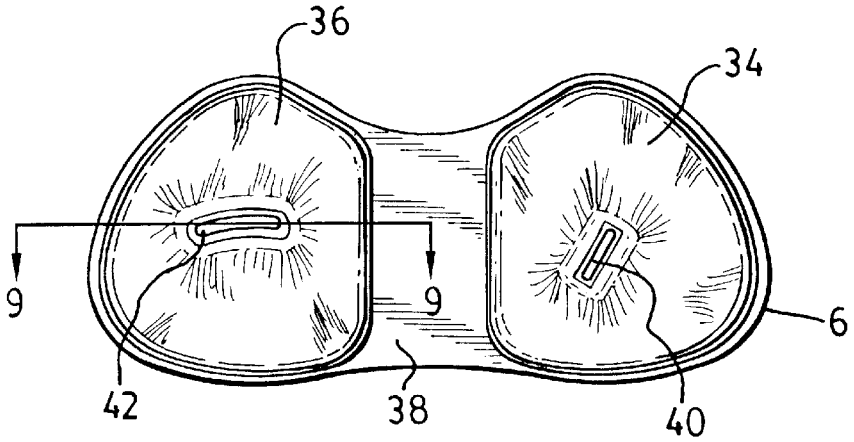
FIG. 8 is a plan view of the cushioning pack.
Figure 9:
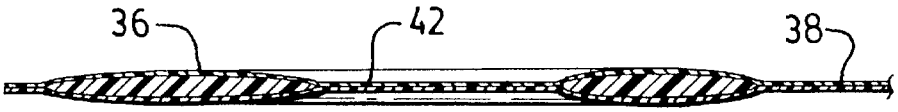
FIG. 9 is a cross-sectional view of a portion of the cushioning pack, at 9—9 of FIG. 8.

The additional cushioning means preferably includes a cushioning pack 6 of flowable gel-like material which will conform to the particular skater's ankle shape. (One such material is that supplied by Alden Laboratories, Inc. of Boulder, Colo. under its Flo trademark.) The preferred cushioning pack is shown in greater detail in FIGS. 7–9, and includes lateral and medial gel pouches 34 and 36 defined between thin layers of plastic, preferably but not necessarily connected by an integral neck portion 38. The cushioning pack may include lateral and medial closed areas 40 and 42, which approximate the path followed by the lateral and medial malleoli when the ankle is flexed, for even greater anatomical correctness and hence comfort and performance. The cushioning pack preferably is overlaid by thin pads 8, of ⅛ inch neoprene rubber for example. This is followed by the soft material lining 10, such as a synthetic leather, the lining preferably having a thin foam layer 12 bonded to the outside thereof.

With the integral or one-piece construction of the insert 4, the ankle portion 20 cannot slump down onto the heel portion 18 with time, which is the problem in the prior art which this invention avoids. The blister-causing pressure point which often results once skates have been used for a length of time is thus avoided.

It will be appreciated that the above description relates to the preferred embodiment by way of example only. Certain variations on the invention will be obvious to those knowledgeable in the field, and such obvious variations are within the scope of the invention as claimed, whether or not expressly described herein.

For example, it should be clearly appreciated that the invention is not restricted to the specific configuration of insert as illustrated herein. Many variations in shape could be contemplated which would still employ the principle of this invention.

For example, as one example only, the slots 34 could be omitted, i.e. the wing portions could be directly connected to the heel portion. This would restrict flexing of the ankle somewhat, and would therefore not be optimal, but would still be within the scope and spirit of the invention.

What is claimed as the invention is:

1. A skate boot having an ankle region and a heel counter region, the skate boot comprising:

a boot-shaped outer;

an insert positioned inwardly from the outer and including three integrally connected portions for cupping a rear part of a wearer's foot, the integrally connected portion insert including a heel portion having lateral and medial side sections, an intermediate winged ankle portion shaped to overlie the wearer's malleoli, and an upper cuff portion configured to wrap at least partially around the wearer's upper ankle; and a liner overlying the insert, wherein the ankle portion of the insert is connected to the heel portion of the insert by at least one connecting member thereby permitting ankle movement when the wearer's foot is received within the boot, wherein the insert is disposed between the liner and the outer thereby adding support to the ankle region and the heel counter region of the boot and preventing the ankle region of the boot from slumping down over the heel counter region of the boot after repeated use, and wherein the outer includes at least two recesses in an area of the ankle portion.

2. The skate boot of claim 1, wherein the ankle portion includes a dished area shaped to overlie the malleoli, and wherein the dished area extends outwardly into the recess of the outer.

3. The skate boot of claim 1, further including a cushioning pack overlying the ankle portion of the insert.

4. The skate boot of claim 3, wherein the cushioning pack contains a gel adapted to conform to the wearer's ankle shape.

5. The skate boot of claim 3, wherein the cushioning pack is made of a rubber material.

6. The skate boot of claim 1, wherein the insert is constructed of a single piece of material.

7. The skate boot of claim 6 wherein the material is plastic.

8. The skate boot of claim 1 further including a cushion layer interposed between the insert and the liner.

9. A skate boot having a heel portion surrounding and supporting the heel of a skater's foot, an ankle portion covering the ankle of the skater, a lateral side portion and a medial side portion extending forward from said heel portion and laterally support each side of the skater's foot, a sole, and a toe portion covering the toes of the skater's foot, said skate boot comprising:

an outer layer of soft material;

an inner lining;

a plastic insert disposed between said outer layer and said inner lining, said insert including a heel counter which cups around the heel of the skater, and a winged ankle counter which surrounds the sides and back of the skater's ankle and is shaped to overlie the skater's malleoli;

said heel counter having separate lateral and medial side segments extending partially along said lateral and medial side portions of said skate boot, terminating short of the skate boot tip and joined together at the rear end of said skate boot thereby forming a U-shape structure which is open at the bottom for allowing width variations between said lateral and medial side segments, said heel counter adding structural support to said heel portion of said skate boot and to said lateral side portion and medial side portion of said skate boot;

said heel counter and said winged ankle counter being connected for limited pivotal motion of said winged ankle counter relative to said heel counter;

said plastic insert being configured for preventing said ankle portion of said skate boot from slumping down over said heel portion of said skate boot after repeated use of said skate boot.

10. A skate boot as defined in claim 9 wherein said separate lateral and medial side segments have lower edges extending partially underneath said insole, said lower edges including cutouts to allow longitudinal flexing of said segments.

11. A skate boot as defined in claim 10 further comprising a thin foam layer bonded to said inner lining and disposed between said insert and said inner lining.

12. A skate boot as defined in claim 11 wherein said plastic insert further comprises an upper cuff portion extending upwardly from said winged ankle counter and configured to wrap at least partially around the back of the skater's Achilles tendon.

13. A skate boot as defined in claim 12 further comprising a cushioning pack including lateral and medial cushions connected together by an integral neck portion, said cushioning pack disposed between said insert and said inner lining and covering the lateral and medial malleoli of the skater's foot.

14. A skate boot as defined in claim 13 wherein said cushioning pack further comprises gel pouches adapted to conform to various ankle shape.

* * * * *

UNITED STATES PATENT AND TRADEMARK OFFICE

CERTIFICATE OF CORRECTION

PATENT NO. 6,079,128

DATED: June 27, 2000

INVENTORS T. Blaine Hoshizaki et al..

It is certified that errors appear in the above-identified patent and that said Letters Patent is hereby corrected as shown below:

IN THE CLAIMS:

Claim 2, Col. 4, line 14, before "ankle" insert --winged--;
Claim 2, Col. 4, line 15, change "dished area" to -- dished areas--;
Claim 2, Col. 4, line 16, change "area extend" to --areas extend--; and
change "recess" to --at least two recesses--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*